US009957740B2

(12) United States Patent
Goetze

(10) Patent No.: US 9,957,740 B2
(45) Date of Patent: May 1, 2018

(54) ADJUSTABLE GEAR LOCK MECHANISM FOR A LIFT AND SLIDE DOOR OR WINDOW

(71) Applicant: Timothy Goetze, Mount Vernon, KY (US)

(72) Inventor: Timothy Goetze, Mount Vernon, KY (US)

(73) Assignee: F.P.L. DOORLOCK HARDWARE, INC., Mount Vernon, KY (US)

( * ) Notice: Subject to any disclaimer, the term of this patent is extended or adjusted under 35 U.S.C. 154(b) by 347 days.

(21) Appl. No.: 14/616,221

(22) Filed: Feb. 6, 2015

(65) Prior Publication Data

US 2015/0218860 A1 Aug. 6, 2015

Related U.S. Application Data

(60) Provisional application No. 61/936,528, filed on Feb. 6, 2014.

(51) Int. Cl.

| | |
|---|---|
| ***E05C 1/06*** | (2006.01) |
| ***E05C 9/16*** | (2006.01) |
| ***E05B 63/00*** | (2006.01) |
| ***E05B 63/06*** | (2006.01) |
| ***E05B 65/08*** | (2006.01) |
| ***E05C 9/02*** | (2006.01) |
| ***E05C 9/20*** | (2006.01) |
| ***E05B 5/00*** | (2006.01) |
| *E05D 15/56* | (2006.01) |

(52) U.S. Cl.

CPC ..... *E05C 9/16* (2013.01); *E05B 5/00* (2013.01); *E05B 63/0056* (2013.01); *E05B 63/06* (2013.01); *E05B 65/08* (2013.01); *E05C 9/02* (2013.01); *E05C 9/20* (2013.01); *E05D 15/565* (2013.01); *E05Y 2800/00* (2013.01); *Y10T 292/102* (2015.04); *Y10T 292/1018* (2015.04)

(58) Field of Classification Search

CPC .... E05B 5/00; Y10S 292/46; Y10T 292/0807; E06B 3/4618

USPC ..... 292/142

See application file for complete search history.

(56) References Cited

U.S. PATENT DOCUMENTS

| | | | | | |
|---|---|---|---|---|---|
| 2,950,756 | A * | 8/1960 | Moloney | E05D 15/0669 | 16/105 |
| 4,958,508 | A * | 9/1990 | Lin | E05C 3/34 | 292/51 |
| 5,456,503 | A * | 10/1995 | Russell, IV | E05B 63/06 | 292/1.5 |
| 5,595,409 | A * | 1/1997 | Fier | E05B 17/042 | 292/112 |
| 5,722,704 | A * | 3/1998 | Chaput | E05B 65/0811 | 292/26 |
| 5,820,170 | A * | 10/1998 | Clancy | E05B 65/0858 | 292/123 |

(Continued)

*Primary Examiner* — Mark A Williams
(74) *Attorney, Agent, or Firm* — King & Schickli, PPLC

(57) ABSTRACT

A gear lock mechanism for use with a door or window adapted to lift and slide. The gear lock mechanism includes a gear channel, an adjustable lock box assembly configured for removably positioning in the gear channel and at least two roller carriages. Each of the at least two roller carriages has a plurality of wheels for moving the door or window to an open and closed position. A backset adapter may be removably connected to the gear lock mechanism.

13 Claims, 20 Drawing Sheets

(56) References Cited

U.S. PATENT DOCUMENTS

| | | | | |
|---|---|---|---|---|
| 5,951,068 | A * | 9/1999 | Strong | E05B 65/0858 292/112 |
| 6,688,656 | B1 * | 2/2004 | Becken | E05B 65/0858 292/26 |
| 7,418,845 | B2 * | 9/2008 | Timothy | E05B 63/185 292/196 |
| 8,496,277 | B2 * | 7/2013 | Commons | E05B 1/0092 292/336.3 |

* cited by examiner

Fig. 15d
Fig. 15b
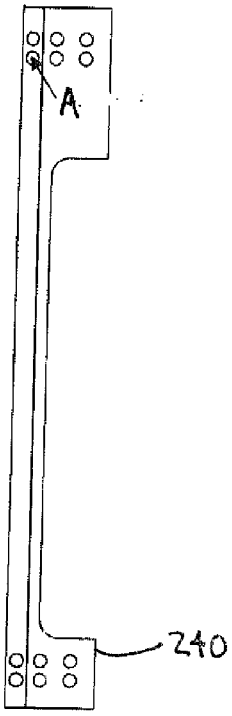
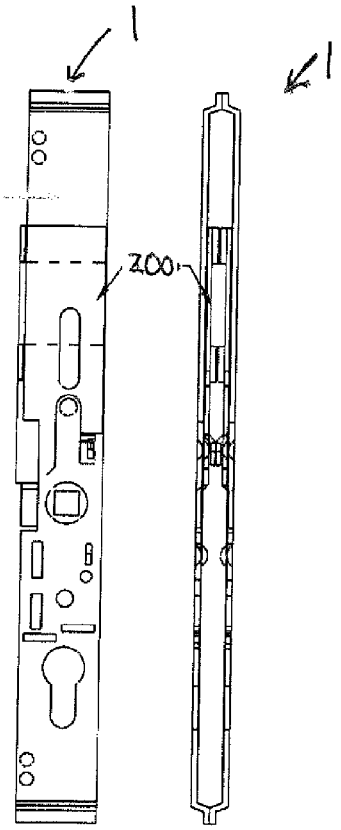
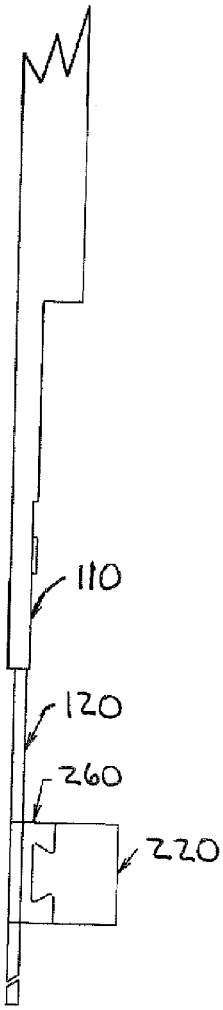
Fig. 15c
Fig. 15e

ADJUSTABLE GEAR LOCK MECHANISM FOR A LIFT AND SLIDE DOOR OR WINDOW

This application claims the benefit of U.S. Provisional Patent Application Ser. No. 61/936,528, filed on Feb. 6, 2014, the disclosure of which is incorporated herein by reference.

TECHNICAL FIELD

This disclosure relates generally to doors and windows adapted to lift and slide and, more particularly, to a variable or adjustable gear lock mechanism including an adjustable lock box and at least one rolling carriage configured to be adaptable for use with either lift and slide doors or lift and slide windows.

BACKGROUND

Typically, exterior non-lift and slide sliding doors or windows include active door panels that do not raise or lower, but have a fixed roller in place. These door or window panels have weather-stripping in contact with the bottom sill, top jamb, side jamb and interlock, which is where the active door or window panel meets with another active door or window panel or fixed door or fixed window panel. During operation, these door or window panels will have weather-stripping that will be in contact with the bottom sill and top jamb at all times.

When opening or closing the active panel of these types of doors and windows, a substantial amount of friction is caused from the weather-stripping of the top and bottom rails because the weather-stripping is in contact at all times with the bottom sill and top jamb in order to seal the panel. This friction creates difficulty in opening and closing a typical sliding door or window panel, which is even more apparent in a non-typical, oversized, thicker, taller, wider, heavier sliding door or window panel. In addition, this friction between the weather-stripping with the bottom sill and top jamb creates greater wear and tear on the bottom sill and top jamb as well as the weather-stripping, which greatly reduces the longevity of the weather-stripping as well as the door or window system as a whole.

As a result, most standard sliding doors or windows designed have the reputation of not sealing particularly well to keep water and outside atmosphere and elements from leaking through the door or window fixture. This problem with the sealing ability may result in water damage, outside atmosphere and elements infiltration as well as less efficient sealing of heating and cooling of living spaces resulting in related elevated energy costs for the homeowner.

In order to address the shortcomings of traditional sliding doors and windows discussed above, lift and slide doors and windows are known in the art. Unlike typical sliding doors or windows, lift and slide doors and windows eliminate the friction problem due to the weather-stripping being in constant making contact with the bottom sill and top jamb. Lift and slide doors and windows are required to have lift and slide hardware in place in order to function. Lift and slide doors and windows have active panels that actually rise and lower when an operator handle is rotated on an axis 180 degrees.

When the active panel is unlocked, the handle can then be rotated, the gear lock mechanism disengages with the multiple jamb strikes and then the panel is raised enough to separate the weather-stripping attached on the top and bottom rails from making contact on the top jamb and bottom sill. The raising of the panel is due to roller carriages typically having two wheels on each carriage (four total wheels) attached to the gear locking mechanism, which raise the panel when the operator door handle is rotated. This action eliminates the friction discussed above and, thus, decreases the difficulty in opening and closing a sliding door or sliding window as well as non-typical, oversized thicker, taller, wider, heavier sliding door or window panels. As a result, lift and slide doors and windows are superior in sealing, operation and efficiency.

When a lift and slide door or window panel is closed and then locked by rotating the handle back by 180 degrees, the gear lock mechanism engages with multiple strikes located on the side jamb and at the same time the panel is lowered down to rest on top of the bottom sill. A keyed lock cylinder can then be rotated to secure the panel from being operated from the outside. This action creates a superior positive seal to prevent water and outside atmosphere and elements from leaking or passing through the door or window fixture. As a result, a lift and slide door is more resistant against water infiltration, outside atmosphere and other elements infiltration with more efficient heating and cooling capability and reduced energy costs. In addition, a more secure opening is created due to the multiple locking points and keyed cylinder port integrated in the lift and slide gear lock mechanism, which locks the door or window panel to the multiple strikes attached to the jamb.

Generally, a lift and slide panel will have a lift and slide operating handle connected to a spindle, which is positioned at the opposite end connected to a hub on a lift and slide gear lock mechanism. The gear lock mechanism includes a long channel having multiple locking ports. The long channel is connected to a lead roller carriage assembly at the bottom of the gear lock mechanism channel. The lead roller carriage assembly is connected to a linkage rod or connecting rod. The linkage rod may be connected to a trailing roller carriage assembly.

With the lift and slide panel in the locked condition, the operating handle is attached to the face of a lock stile pointing straight up at the ceiling in a upward vertical condition parallel to the panel's vertical edge. The gear lock mechanism is attached to a lock stile and is locked or engaged onto the multiple strikes located on the jamb. The panel is in the lowered condition resting on the bottom sill resulting in substantial sealed condition with the bottom sill and top jamb, side jamb and interlock. A keyed lock cylinder after being engaged prevents opening the panel from the outside.

With the lift and slide panel in the unlocked condition, the keyed lock cylinder being disengaged, the operating door handle is attached to the face of the lock stile and is pointing straight down to the floor in a downward vertical condition parallel to the panel's vertical edge. The gear lock mechanism is attached to the lock stile is unlocked from or disengaged from the multiple strikes located on the side jamb. The panel is in a raised condition away from the bottom sill and top jamb enough so that the weather-stripping on the bottom rail of the panel is not in contact with the bottom sill and that the top rail weather-stripping is not in contact with the top jamb. The panel can then be moved along the track with less friction to create an opening, which allows for easier opening and closing of a panel.

Although lift and slide doors and windows alleviate a number of problems associated with traditional sliding doors and windows, they still suffer from certain limitations. For example, the lift and slide gear lock mechanisms associated with lift and slide doors and windows known in the art have fixed or permanent backsets. The fixed backsets are typically positioned at standard heights, such as 27.5 mm and 37.5 mm. As a result, if it is desired to position a backset at a different location, gear lock mechanisms with different backsets have to be purchased separately for door or for windows, which decreases efficiency with respect to time and expense. In addition, as noted above, the roller carriages are limited to two wheels (or four total wheels) for moving the lift and slide door, which is not ideal for displacement of the weight of the door and efficient operation of the lift and slide door.

Accordingly, there is a need for a variable gear lock mechanism with an adjustable configurable backset in various sizes, such as 27.5 mm, 37.5 mm and 50 mm for use with lift and slide doors and/or windows. Moreover, there is a need for an adjustable lock box that may be configured to operate with the gear lock mechanism in a door position and a window position. Finally, there is a need for roller carriages for use with the gear lock mechanism having more than four wheels to displace greater weight and operate more efficiently.

SUMMARY

In accordance with one aspect of the disclosure, a gear lock mechanism for use with a door or window adapted to lift and slide is provided. The gear lock mechanism includes a gear channel, an adjustable lock box assembly configured for removably positioning in the gear channel and at least two roller carriages. Each of the at least two roller carriages has a plurality of wheels for moving the door or window to an open and closed position.

In one embodiment, the gear lock mechanism has a first and second pair of vertically spaced holes. The gear lock mechanism may further include a backset adapter removably connectable to the gear lock mechanism. The backset adapter may have a corresponding first and second pair of vertically spaced holes. The backset adapter may have a first portion and a second portion wherein the first portion is configured to fit within the gear channel of the mechanism such that the first pair and corresponding first pair of vertically spaced holes align and the second pair and corresponding second pair of vertically spaced holes align. Further, the second portion of the backset adapter may be substantially flush to the gear channel of the mechanism when the first pair and corresponding first pair of vertically spaced holes and the second pair and corresponding second pair of vertically spaced holes are aligned. The lock box assembly may removably attachable to the backset adapter in one of two positions or removably attachable directly to the gear lock mechanism channel.

In accordance with another aspect of the disclosure a variable gear lock mechanism for use with a door or window adapted to lift and slide is disclosed. The variable gear lock mechanism includes: (1) a gear channel; (2) an adaptable backset adapter configured for removably connecting to the gear lock mechanism; (3) an adjustable lock box configured for removably connecting to the backset adapter; (4) a first roller carriage having four wheels; and (5) a second roller carriage having four wheels connected to the first roller carriage. The first and second roller carriages are configured for moving the door or window to an open and closed position.

In one embodiment, the variable gear lock mechanism may have a connector for connecting the first and second roller carriages. The mechanism may further have an intermediate roller carriage positioned between the first and second roller carriages. The intermediate roller carriage also has four wheels. The backset adapter may be configurable to modify the mechanism for use in a door position and a window position. Further, the backset adapter may have a first row of two horizontally spaced holes at a top end and a second row of two horizontally spaced holes at a bottom end. The lock box may have a corresponding hole at a top end for aligning with one of the two horizontally spaced holes of the backset adapter at the top end and a corresponding second hole at a bottom end for aligning with one of the two horizontally spaced holes of the backset adapter at the bottom end.

In yet another aspect of this disclosure an improvement in a lift and slide door or window having a gear lock mechanism wherein the mechanism has a front channel with a door position and a window position is disclosed. Specifically, the improvement is a lock box for removably connecting to the front channel in the door position or the window position.

BRIEF DESCRIPTION OF THE DRAWINGS

The accompanying drawings incorporated in and forming a part of the specification, illustrate several aspects of this disclosure, and together with the description serve to explain the principles of the disclosure. In the drawings:

FIGS. 15*a*-15*e* are various views of the gear lock mechanism being configured for different orientations forming one aspect of this disclosure.

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized and that process or other changes may be made without departing from the scope of the disclosure. The following detailed description is not to be taken in a limiting sense, and the scope of the disclosure is defined only by the appended claims and their equivalents. In accordance with the disclosure, a variable or adjustable gear lock mechanism for a lift and slide door or window is hereinafter described.

Figure 1:
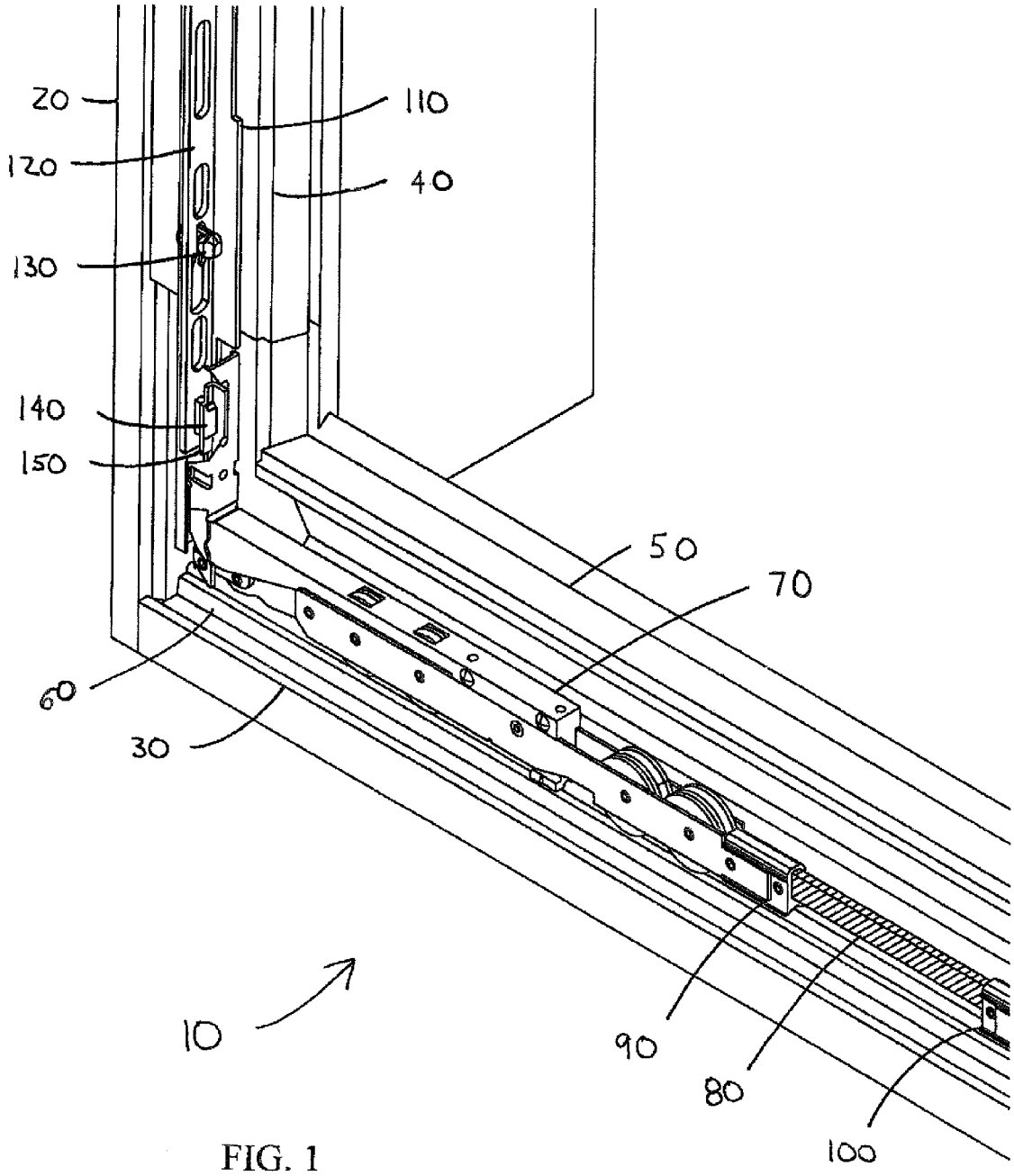
FIG. 1 is a partial cut-away inside view of a lift and slide door in a closed and lowered orientation forming one aspect of this disclosure.

Reference is now made to FIGS. 1-15, which illustrate an adjustable gear lock mechanism 1 for a lift and slide door or window. The gear lock mechanism 1 is typically made of stainless steel, aluminum, brass and zinc alloy. A representative lift and slide door 10 for which the gear lock mechanism may be used is shown in FIG. 1. The door 10 it a standard lift and slide door having a door jamb 20, a bottom sill 30, a lock stile 40 and a bottom rail 50 with a door track 60 located there between. A lead roller carriage 70 is positioned within the door track 60 and connected to the gear lock mechanism 1. The four wheels associated with the lead roller carriage 70 may be stainless steel precision bearing nylon and fiberglass wheels. It should be appreciated that the other roller carriages associated with the present disclosure (and discussed in more detail below) are of a similar construction. The lead roller carriage 70 includes a connector or rod 80 located between a pair of roller carriage couplers 90, 100.

The gear lock mechanism 1 is substantially rectangular shaped with rear or base having a plurality of holes for connecting to the door or window. Two sides extend from the rear and base and a front channel or recess 110 is formed between the two sides. The front channel 110 is relatively long and has a door position and a window position for adjustably positioning an adjustable lock box 210 and an adjustable backset adapter 240. Specifically, each side of the front channel 110 has a first set of aligned holes including a pair of parallel, vertically aligned mounting holes A spaced from a second set of aligned mounting holes including a pair of parallel, vertically aligned holes B. The first and second set of aligned mounting holes is positioned in a door position. The front channel 110 further has a third set of aligned mounting holes including a pair of parallel, vertically aligned holes C spaced from a fourth set of aligned mounting holes including a pair parallel, vertically aligned holes D. The third and fourth set of aligned mounting holes is positioned in a window position. The holes are used with fasteners, such as screws to connect to either the adaptable backset 240 or directly to the lock box assembly 210. A lock bar 120 is positioned adjacent to the front channel 110 and the front channel further has at least one strike 130, a coupler pin 140 and a roller coupler plate 150. A finger edge pull may be installed within a port located in the channel. Further, a channel extension may be added to extend the overall length of the channel for taller doors, i.e., for doors taller than standard sized doors.

Figure 2:
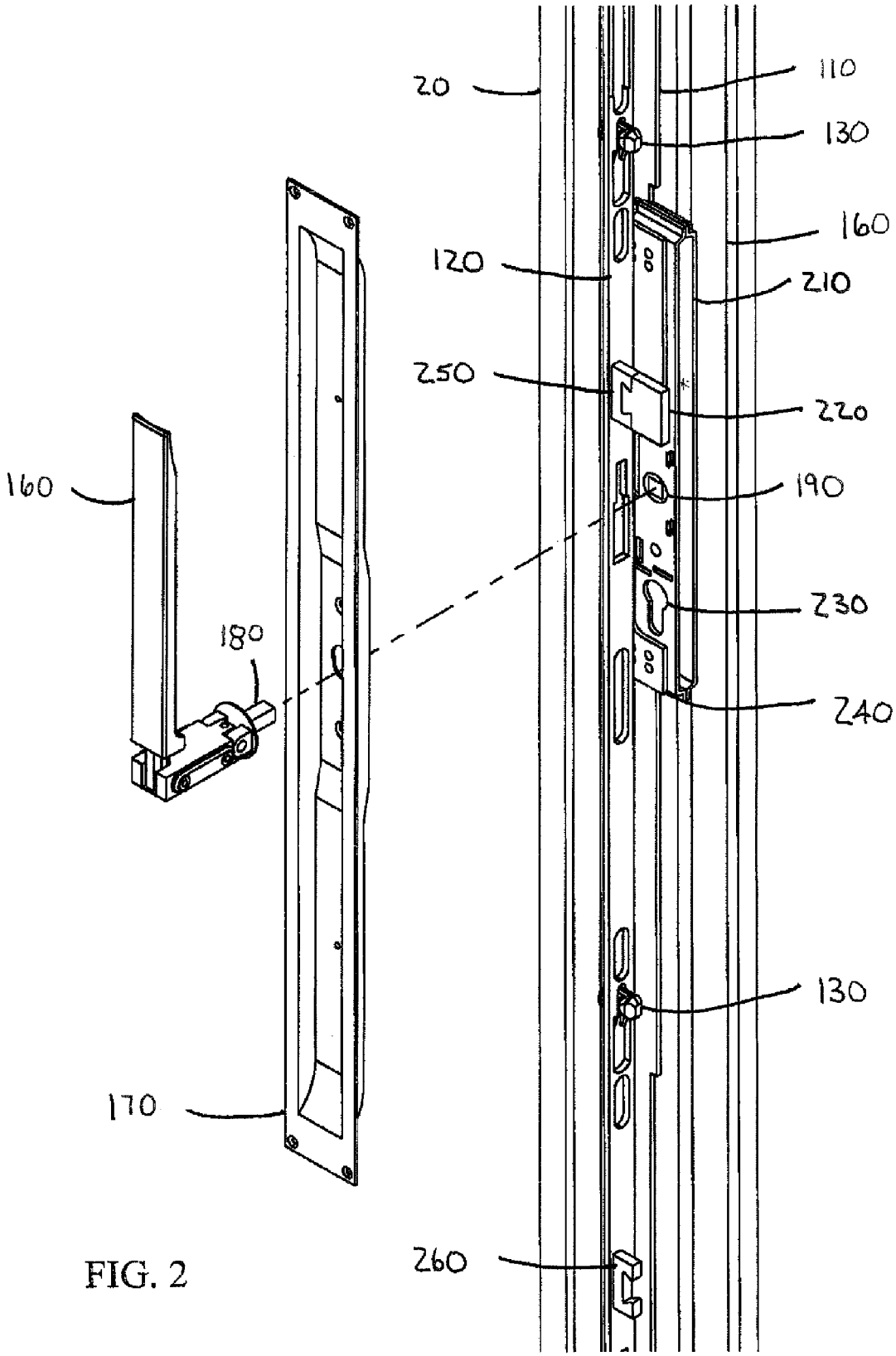
FIG. 2 is a side perspective view of a gear lock mechanism in a closed and lowered orientation forming one aspect of this disclosure.

With respect to FIG. 2, a lift and slide door handle 160 is shown in a closed and lowered orientation, i.e., the handle is pointed upwards. The handle 160 connects to the lift and slide door handle flush trim 170. The handle includes a spindle 180 which connects to a spindle hub 190 located on the lock box assembly 210 forming a part of the gear lock mechanism 1. The lock box assembly has a lock drive port 200, a lock drive 220 and lock cylinder hole 230. Furthermore, a door position lock drive connector 250 and window position lock drive connector 260 are shown. The lock box assembly 210 can be unscrewed and fastened to a higher door position or a lower window position as discussed in more detail below.

Figure 10A:
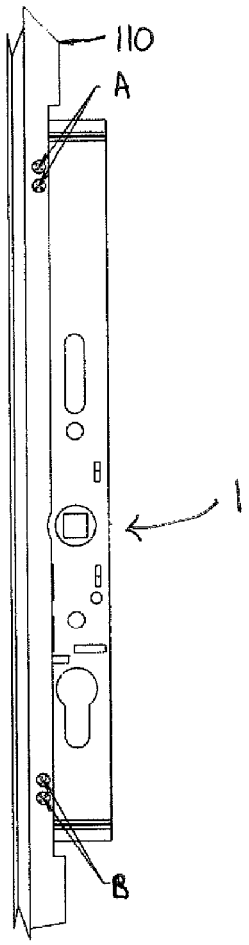
FIGS. 10*a*-10*c* are side views of a gear lock mechanism with an adjustable backset in various configurations forming one aspect of this disclosure.
Figure 10B:
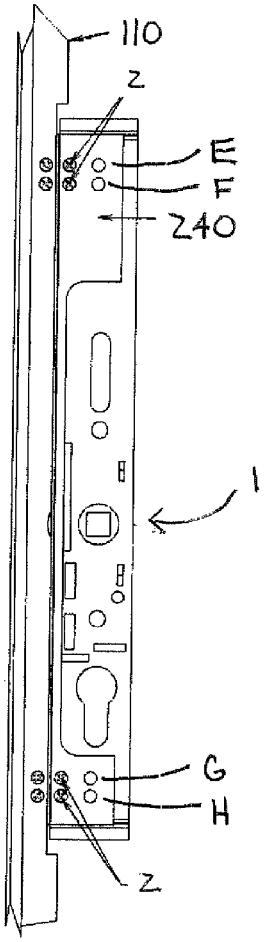
Figure 10C:
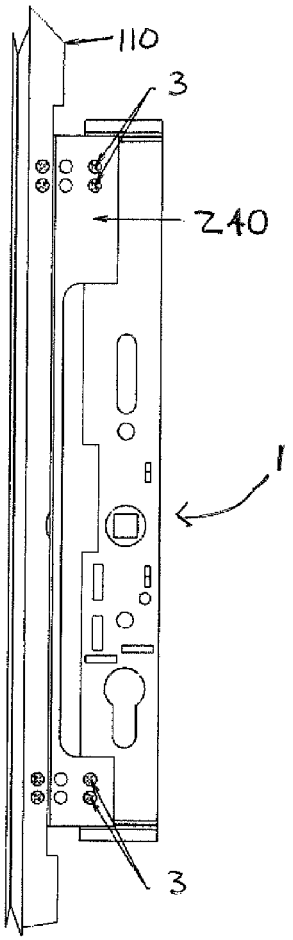

Turning to FIGS. 10*a*-10*c* and FIGS. 15*a*-15*e*, the adjustable backset adapter 240 is also illustrated. The backset adapter 240 may be positioned within the channel 110. The backset adapter has four rows E, F, G and H of aligned of holes (as shown in groups of three) that align horizontally and are parallel with the holes on the front channel. The first hole of each row is on a portion of the backset adapter that is shaped to fit within the channel. The other portion of the backset adapter extends substantially flush in the horizontal with the gear lock mechanism and is positioned within a groove in the gear lock mechanism channel. Fasteners are used through the first hole in the backset adapter and the corresponding holes on the gear lock mechanism to attach the adapter directly to the gear lock mechanism. When the backset adapter is connected to the gear lock mechanism, two rows of three holes are aligned at the top and bottom of the backset adapter (as shown in FIGS. 10*b* and 10*c*). The backset adapter has a recessed body portion such that it does not cover up certain portions of the lock box assembly when, in use, the lock box assembly is connected to the adapter.

It further may be configured in different positions within the channel to lift and slide doors and windows. Moreover, to configure the backset for 37.5 mm, the backset adapter may be attached to front channel with fasteners using the first holes as discussed above. The lock box assembly 210 is inserted into the backset adapter 240 while guiding the lock box assembly over the lock drive 220. The lock box assembly is attached to the backset adapter via fasteners through the second holes 2 (as shown in FIG. 10*b*). If it is desired to change the backset from 37.5 mm to 50 mm, the fasteners are removed from the second holes on the backset adapter. The lock box assembly is moved out to line up with the third holes 3 on the backset adapter and re-attached with fasteners (as shown in FIG. 10*c*). If the backset is desired to be used at 27.5 mm, the backset adapter may be removed as shown in FIG. 10*a*. Specifically, all of the fasteners may be removed from the holes on the front channel and backset adapter, respectively. The lock box assembly is removed from the backset adapter and the lock box assembly is inserted directly into the front channel of the gear lock mechanism while guiding the lock box assembly over the lock drive. The lock box assembly is attached to the channel with fasteners using holes.

In order to configure the gear lock mechanism 1 to a door or window position, the fasteners are removed from holes and the lock box assembly and backset adapter are removed from the front channel. With the lock drive 220 still attached to the lock bar 120, the lock bar is slid down until the lock drive connector clears the bottom end of the channel. The lock drive is shaped like a puzzle piece on one end. The lock drive is removed from the lock drive connector by sliding the lock drive sideways to disengage it from the lock drive connector. The lock drive is repositioned to the other lock drive connector position and slid into place. After the lock drive is attached, the lock bar is slid up into the front channel to the new position. The backset is then configured in the appropriate position as discussed above. Once the backset is positioned, the lock drive is guided into the lock drive port on the lock box. The lock box assembly is firmly attached via fasteners into holes.

Figure 3:
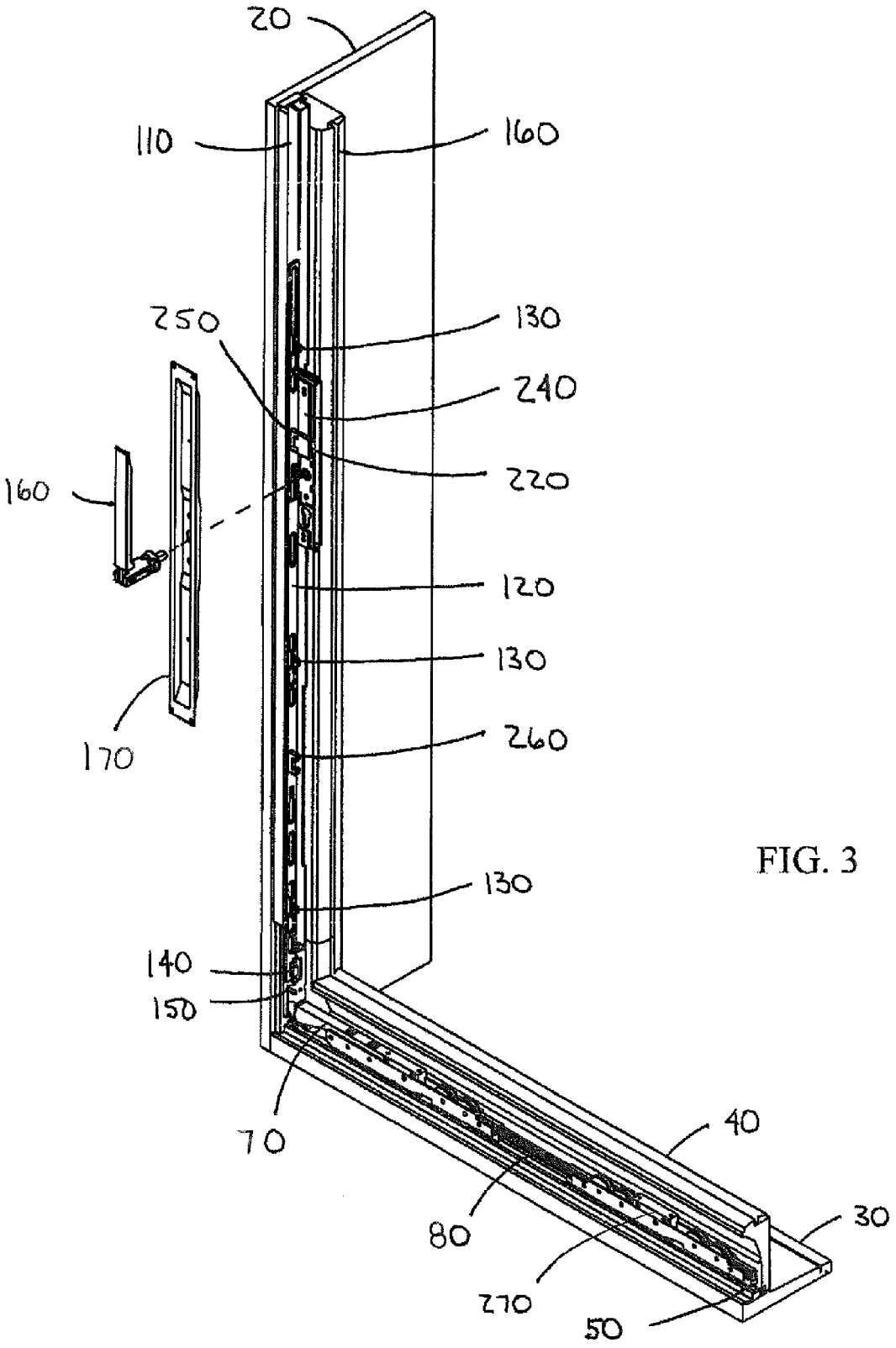
FIG. 3 is a side perspective view of a lift and slide door with lead and trailing roller carriages in a closed and lowered orientation forming one aspect of this disclosure.
Figure 4:
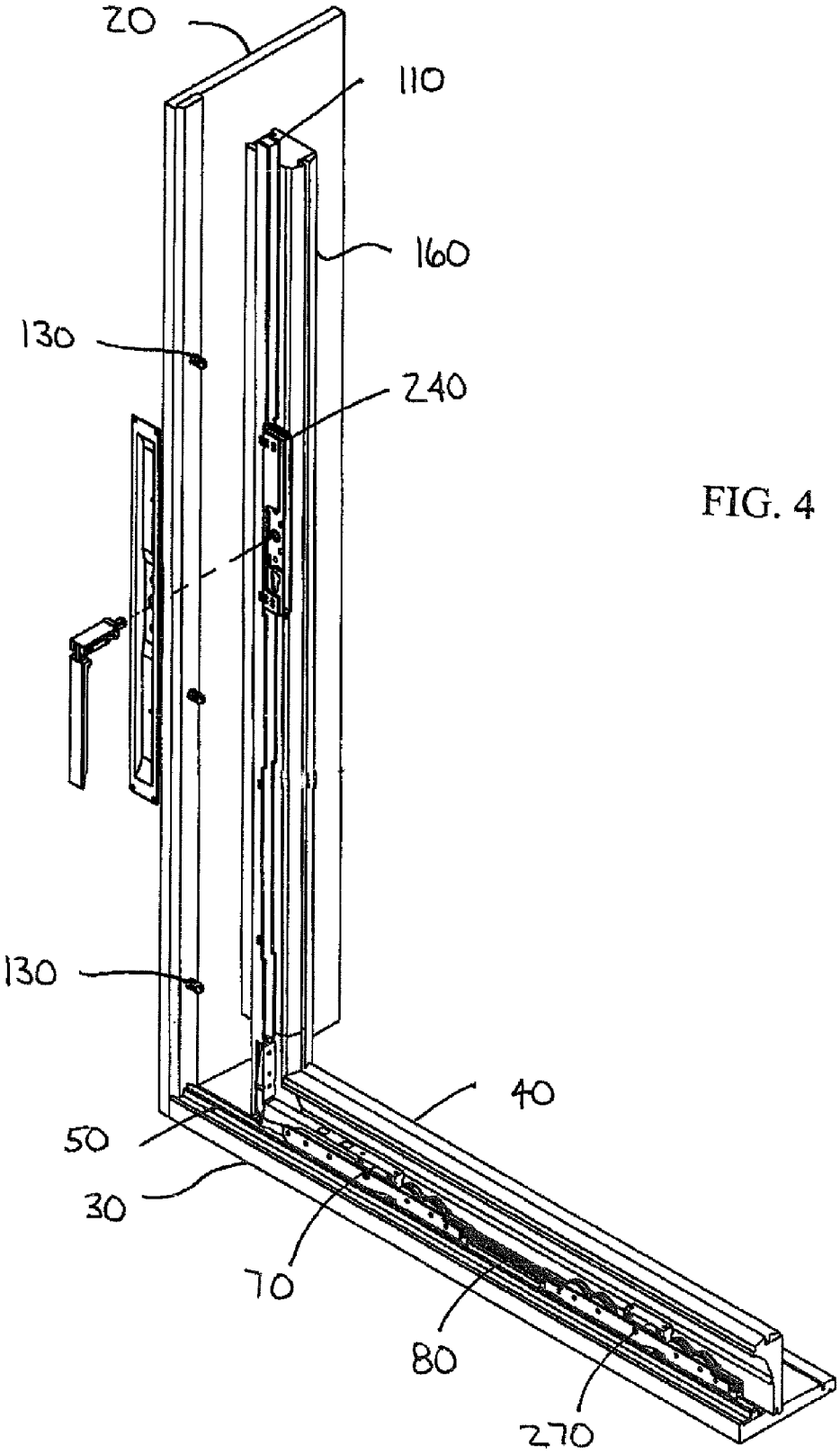
FIG. 4 is a side perspective view of a lift and slide door with lead and trailing roller carriages in an open and raised orientation forming one aspect of this disclosure.
Figure 5:
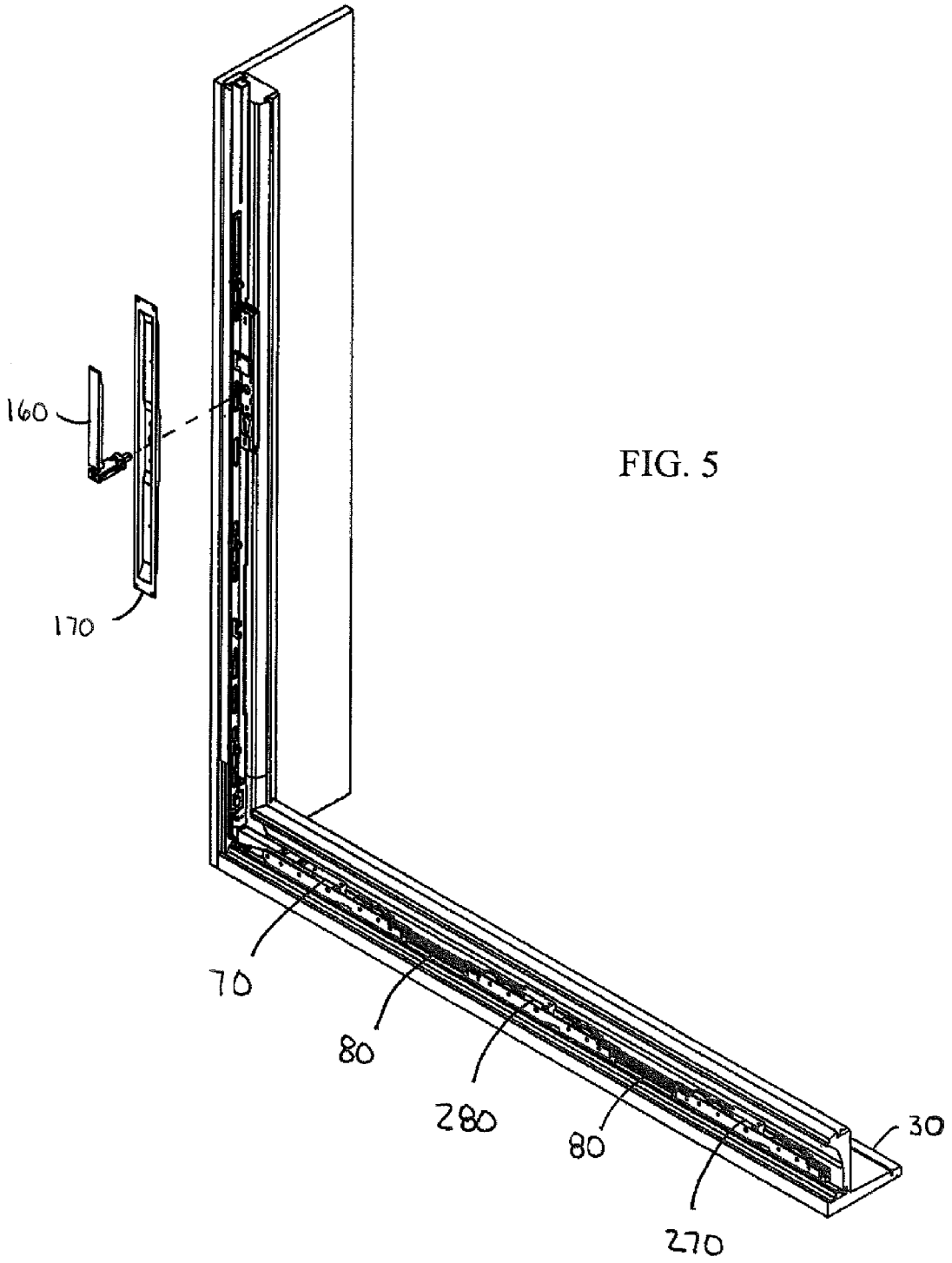
FIG. 5 is a side perspective view of a lift and slide door with lead, intermediate and trailing roller carriages in a closed and lowered orientation forming one aspect of this disclosure.
Figure 6:
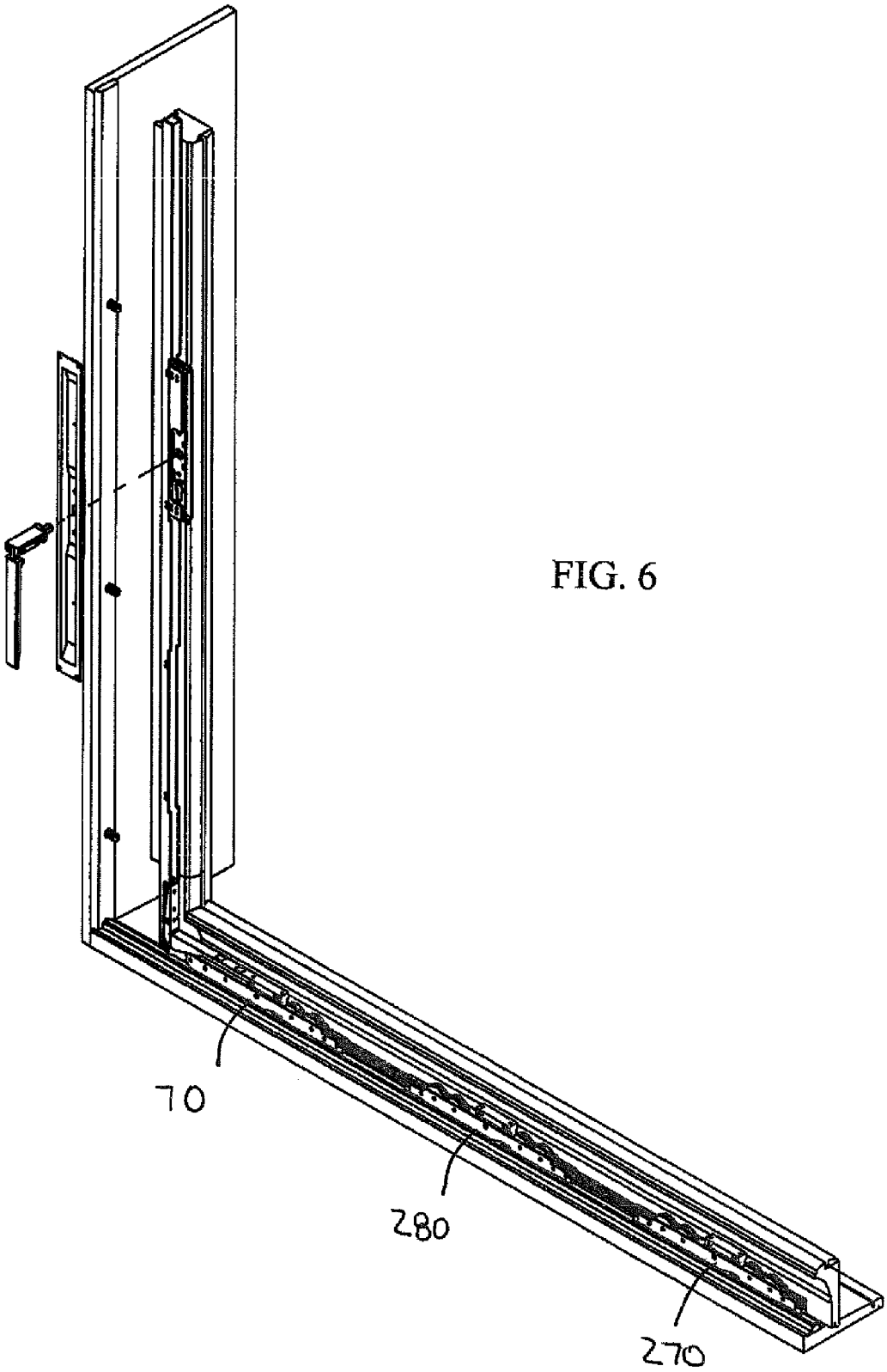
FIG. 6 is a side perspective view of a lift and slide door with lead, intermediate and trailing roller carriages in an open and raised orientation forming one aspect of this disclosure.

Turning to FIG. 3, it illustrates the leading roller carriage 70 connected to the gear lock mechanism 1 in a closed and lowered orientation and a trailing roller carriage 270 also in closed and lower orientation. The trailing roller carriage 270 also has four wheels, such that the leading and trailing roller carriages have a total of eight wheels, which helps to displace the weight of the door or window. FIG. 4 shows the lift and slide door handle in an open and raised orientation, i.e., the handle is pointed downwards. FIG. 4 further illustrates a configurable window position port for the lock box assembly and backset adapter. FIGS. 5 and 6 illustrate an intermediate roller carriage 280 positioned between the leading roller carriage 70 and the trailing roller carriage 270 in a closed and lowered orientation and an open and raised orientation, respectively. The intermediate roller carriage also has four wheels, which allows for greater weigh displacement.

Figure 7:
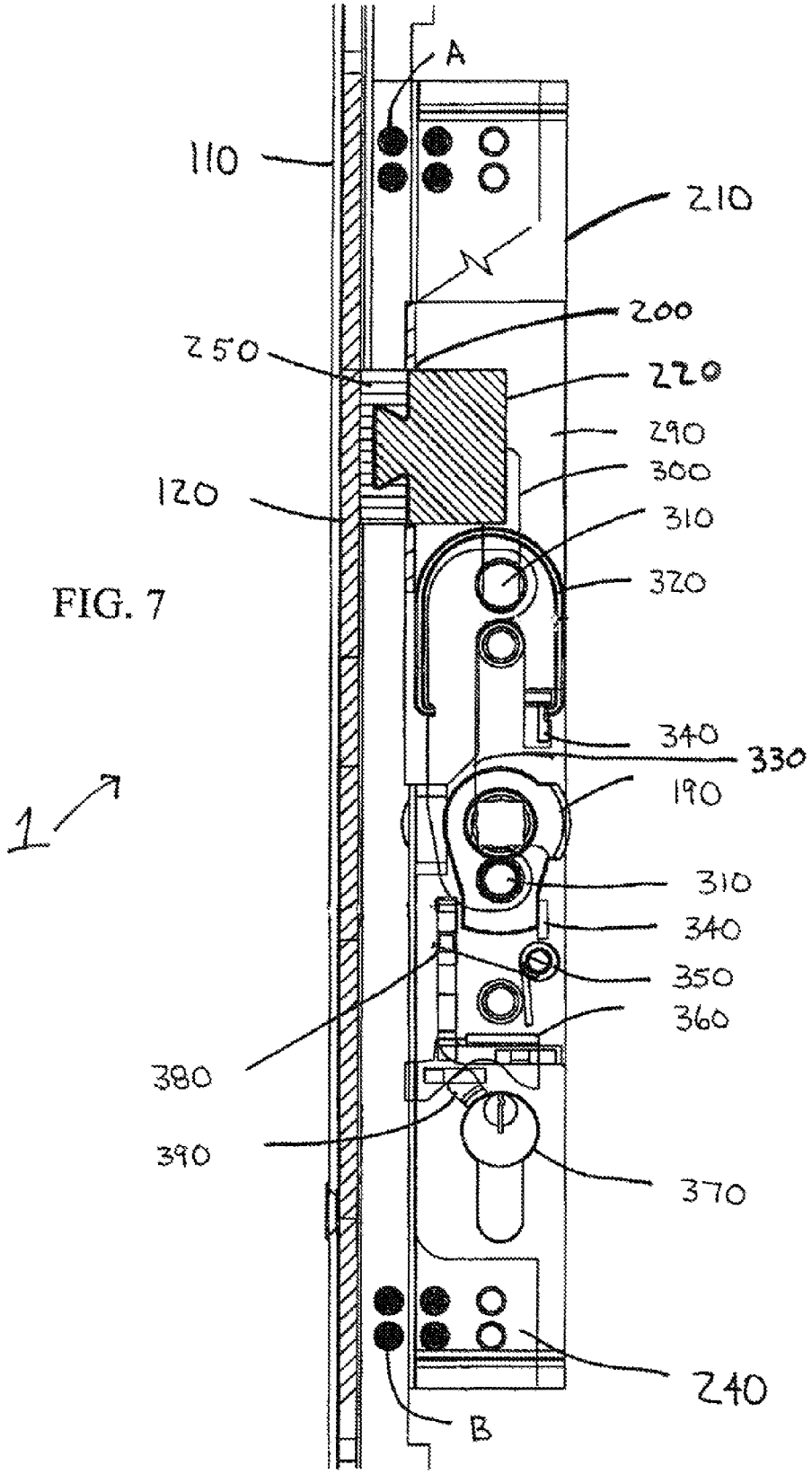
FIG. 7 is a front view of a gear lock mechanism in a lowered, closed and locked orientation forming one aspect of this disclosure.
Figure 8:
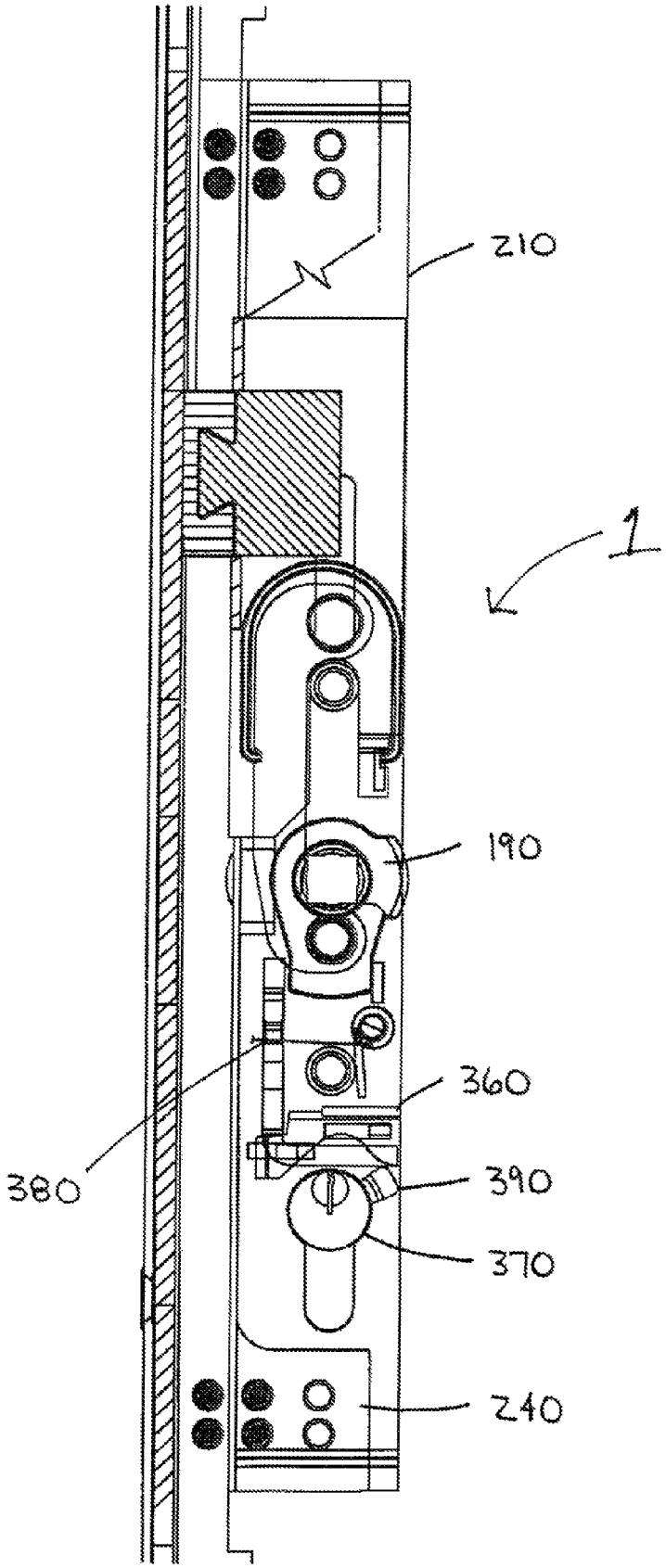
FIG. 8 is a front view of a gear lock mechanism in a lowered, closed and unlocked orientation forming one aspect of this disclosure.
Figure 9:
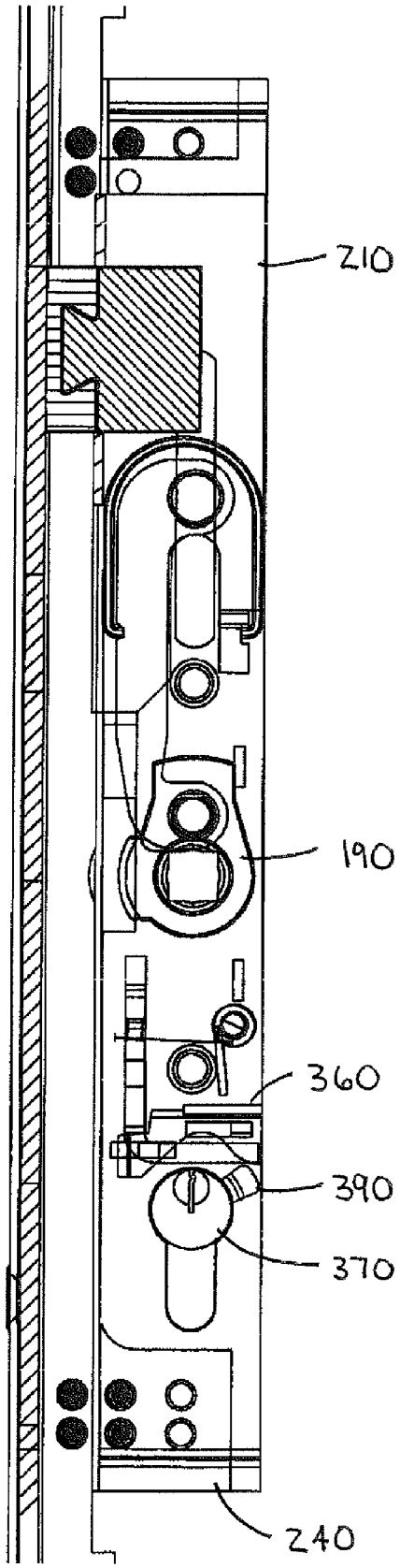
FIG. 9 is a front view of a gear lock mechanism in a raised and open orientation forming one aspect of this disclosure.

With reference to FIGS. 7-9, the lift and slide gear lock mechanism is shown in closed and locked orientation, a closed and unlocked orientation and raised and open orientation. The gear lock mechanism includes the lock drive connector 250, a lock drive plate 290, at least one guide slot 300, at least one pin coupler 310, a tension spring 320, a linkage 330, at least one hub stop 340, a lock spring 350, a cam plate 360, a lock cylinder 370, a lock plate 380 and a cylinder cam 390.

Figure 11A:
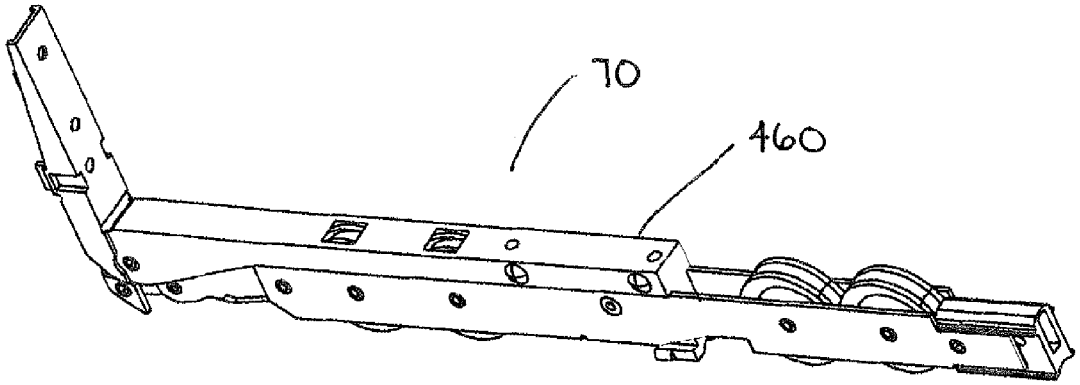
FIGS. 11*a*-11*c* are side views of a lead roller carriage in a lowered and raised orientation forming one aspect of this disclosure.
Figure 11B:
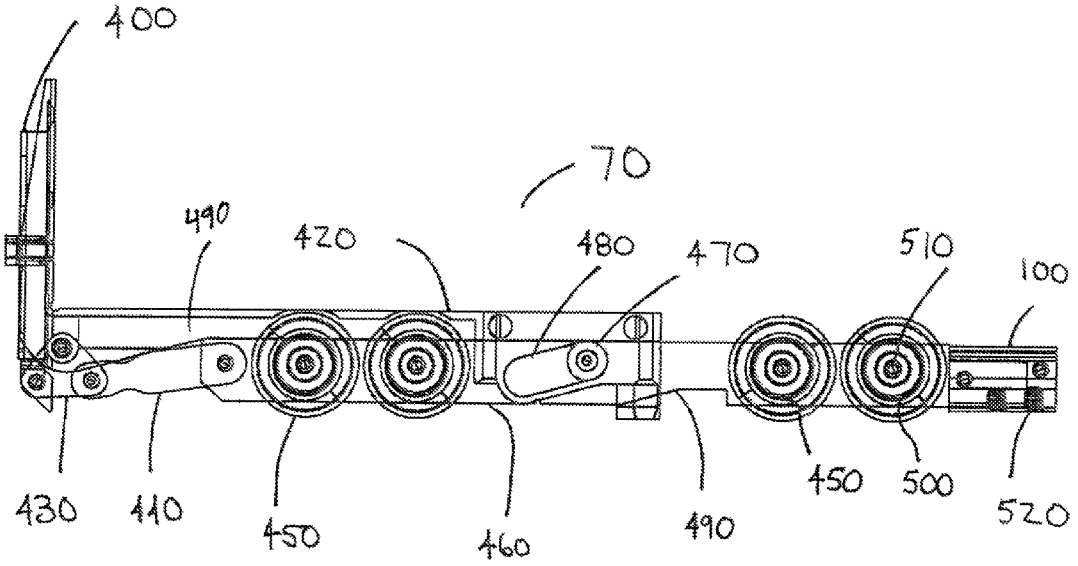
Figure 11C:
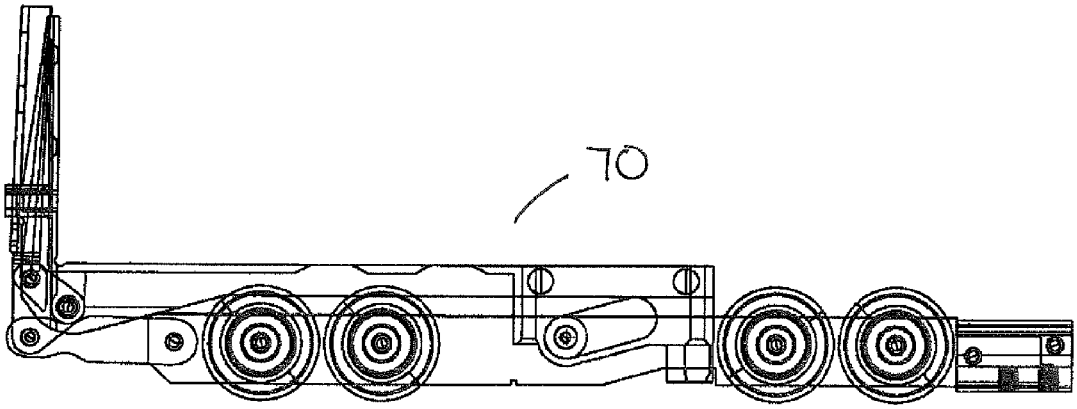
Figure 12A:
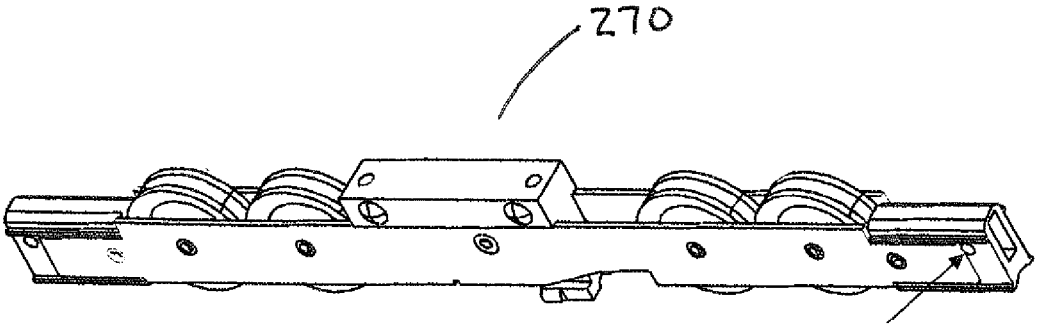
FIGS. 12*a*-12*c* are side views of a trailing roller carriage in a lowered and raised orientation forming one aspect of this disclosure.
Figure 12B:
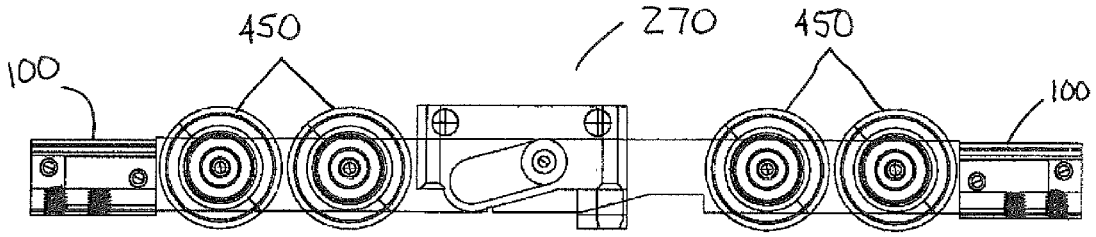
Figure 12C:
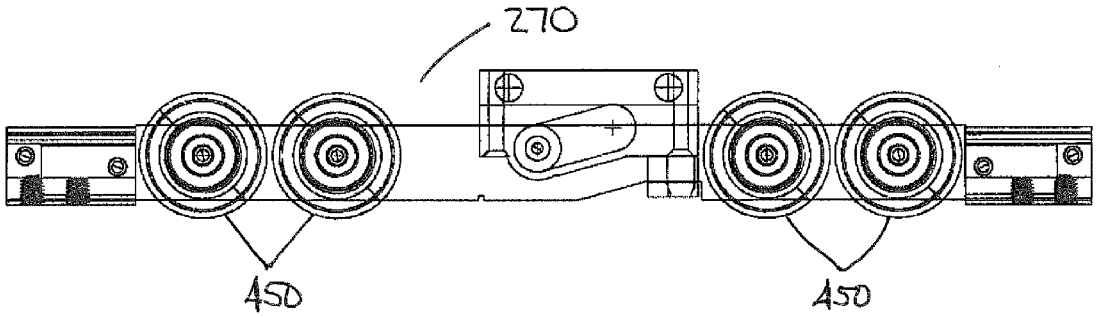

Turning to FIGS. 11*a*-11*c* and 12*a*-12*c*, the lead and trailing roller carriages are shown in both a lowered and raised orientation. As illustrated in FIGS. 11*a*-11*c*, the lead roller carriage 70 has a roller carriage coupler plate 400 on one end and a multiple carriage coupler 100 on an opposite end. A mounting bracket 420 has a pivot linkage 430, a linkage 440, and a pair of wheels 450 located in a housing 460. The bracket further has a bearing 470, a guide slot 480 and a guide edge 490. The carriage further has a wheel bearing 500 and a rivet 510. A connecting rod mounting screw 520 is located in the multiple carriage coupler. The trailing roller carriage 270 shown in FIGS. 12*a*-12*c* is of similar construction and is positioned between a pair of multiple carriage couplers 100.

Figure 13:
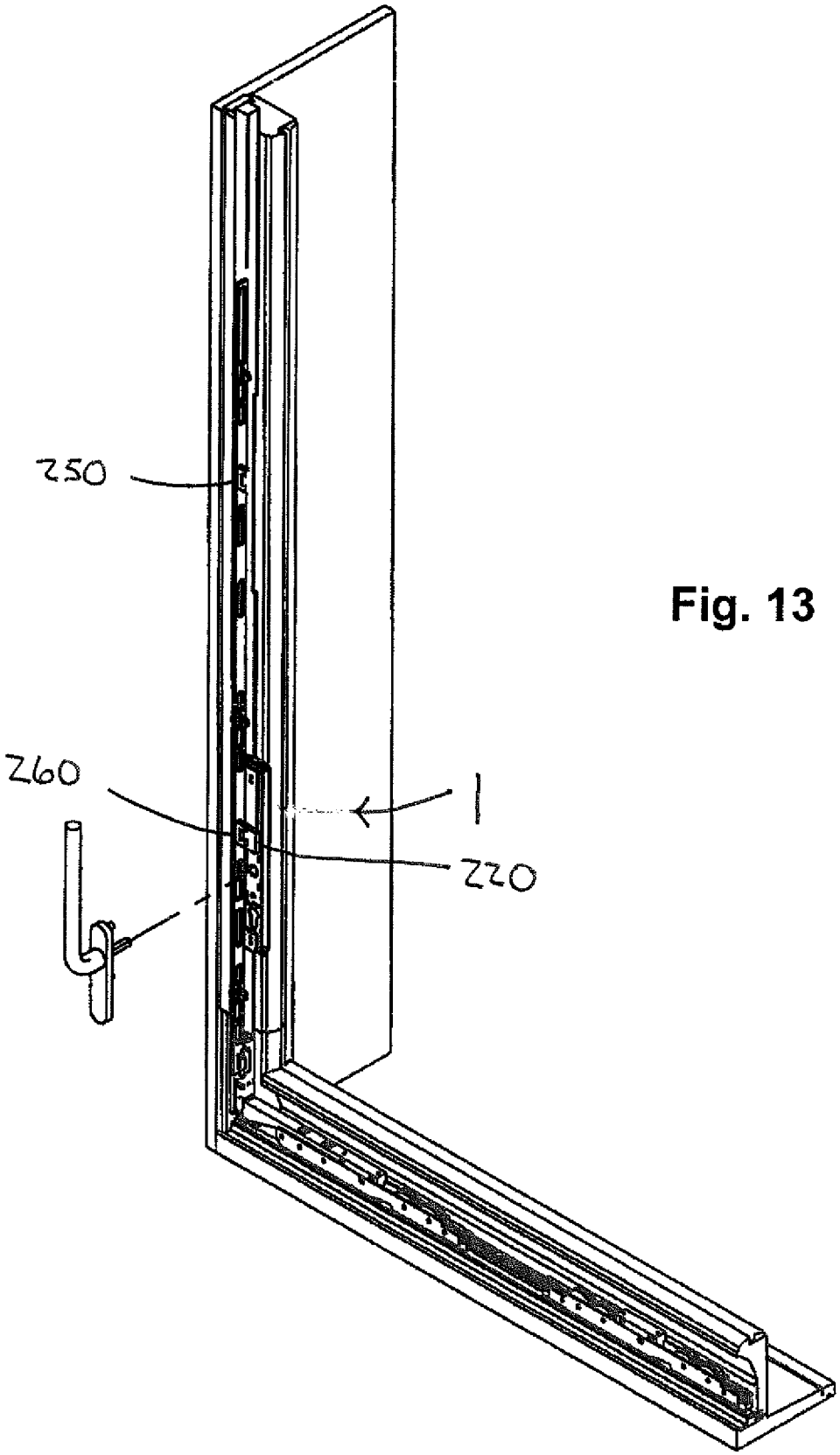
FIG. 13 is a perspective view of a lift and slide window with lead and trailing roller carriages in a closed and lowered orientation forming one aspect of this disclosure.
Figure 14:
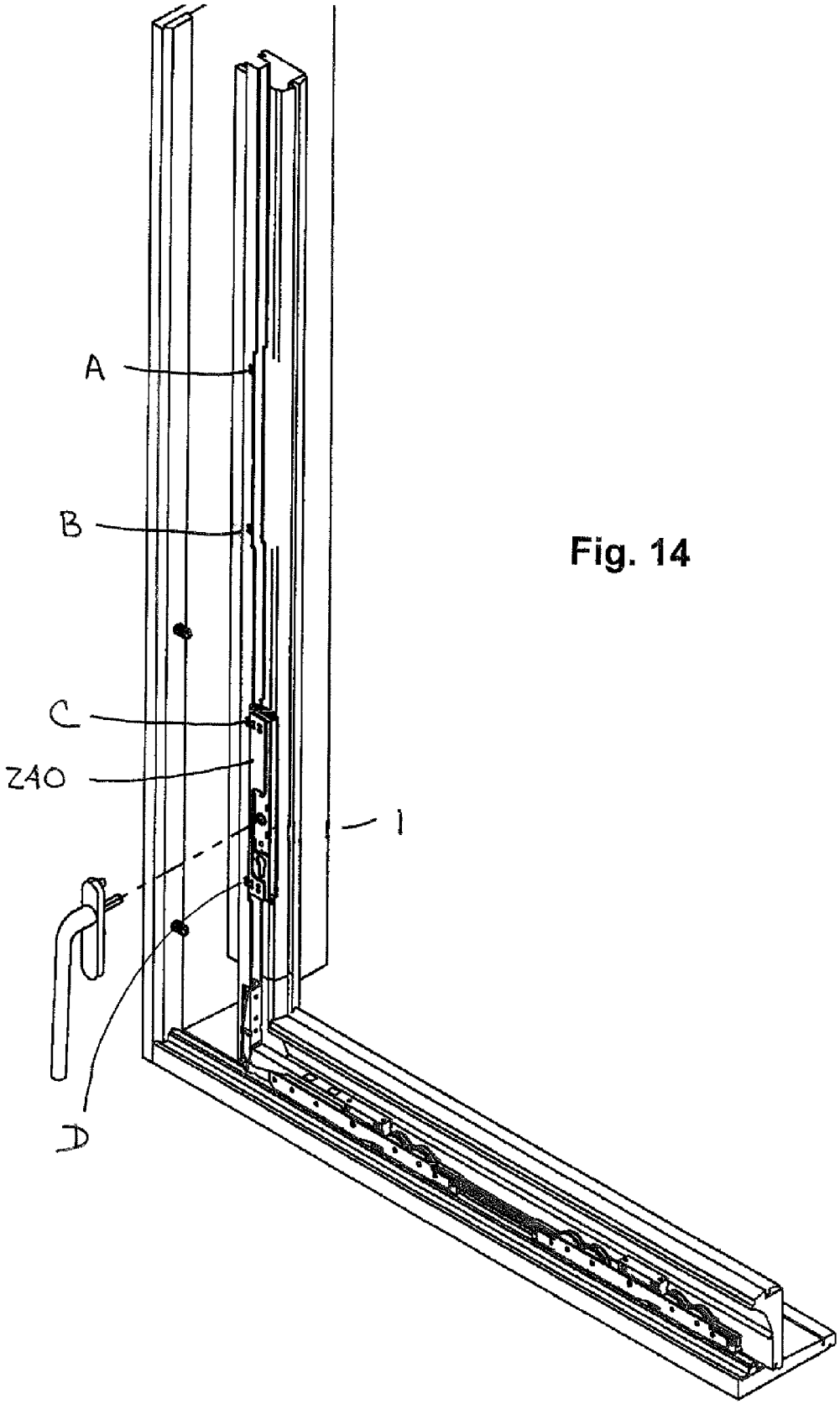
FIG. 14 is a perspective view of the lift and slide window with lead and trailing roller carriages in an open and raised orientation forming one aspect of this disclosure.

Finally, FIGS. 13 and 14 illustrate a lift and slide gear lock mechanism for a window with lead and trailing roller carriages in closed and lowered orientation and open and raised orientation. In addition to the adjustable backset mentioned above, the gear lock mechanism is configured to be used on lift and slide windows. The gear lock mechanism has two configurable height positions. The door position handle height is typically at the average handle height of typical door locks. The window position handle height is typically at a lower average handle height of typical window locks. The window position also has the adjustable backset capability as the door position. To configure the gear lock mechanism to be either for door or for window, the lock box assembly is removed by removing screws and then moved from the one position and re-attached to the other position with screws.

As noted above, the lift and slide gear lock mechanisms known in the art have fixed backsets, which are typically 27.5 mm and 37.5 mm. Gear lock mechanisms with different backsets have to be purchased separately for door or for windows. Accordingly, the lift and slide gear lock mechanism with an adjustable configurable backset disclosed herein is available for use in various sizes, such as 27.5 mm, 37.5 mm and 50 mm. This type of backset is particularly advantageous due to the varying stile widths door and window manufacturers currently offer. For example, if wider stiles of 4" is needed depending on the size of the lift & slide panel, a 50 mm backset will enable the door and window manufacturer to place the operator handle in the mid-point on the face of the door stile.

Figure 15A:
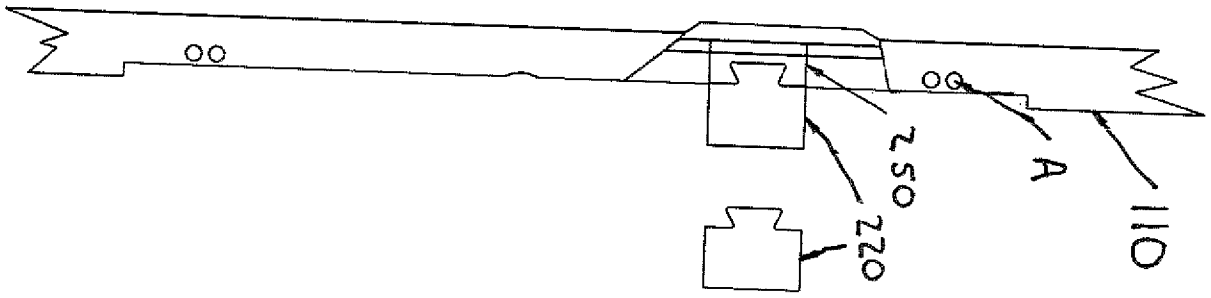

The backset is adjustably configurable by removing screws, moving the lock box assembly to the needed backset and replacing the screws in the new holes. Specifically, in use, the backset adapter is not typically used with the gear lock mechanism in the 27.5 mm position. Instead, all the fasteners are removed from the corresponding holes on the gear lock mechanism front channel and backset adapter. The lock box is then removed from the backset adapter and connected directly to the gear lock mechanism front channel while guiding the lock over the lock drive as shown in FIG. 15*a*. The lock box assembly is attached to the front gear lock mechanism channel using fasteners inserted into holes.

One of the primary benefits of the lift and slide gear lock mechanism with configurable adjustable backset is that the door and window manufacturer can purchase and stock a single lock that can be configured for door or for window in the three backsets instead of stocking three different backsets of door and three different backsets of window lock mechanisms.

Currently in the marketplace, typical lift and slide roller carriages have only two wheels per carriage and can only support a panel having a maximum weight capacity of only 550 pounds. Larger size, heavier panels are popular in the building industry and there are no adequate heavier duty lift and slide roller carriages on the market to meet this need. The lift and slide roller carriages disclosed herein may be equipped with at least four wheels per carriage to displace weight more evenly and support a maximum weight capacity of 800 pounds per roller carriage. In other words, the front and rear carriage have a total of at least eight wheels corresponding to a single door or window panel. This weight capacity has been tested, passed and certified by an accredited fenestration laboratory in the United States. Regarding the trailing or rear roller carriage, a connector was designed on the rear end of the housing so that additional roller carriages can be added if needed depending upon the size and weight of panel to be used.

The foregoing descriptions of various embodiments are provided for purposes of illustration, and are not intended to be exhaustive or limiting. Modifications or variations are also possible in light of the above teachings. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention.

The invention claimed is:

1. A gear lock mechanism for use with a door or window, the door or window adapted to lift and slide within a track, the gear lock mechanism comprising:

a vertically oriented front channel having a first lock drive connector located in a door position of the front channel and a second lock drive connector located in a window position of the front channel;

an adjustable backset adapter removably connectable to the front channel at one or more horizontally spaced locations of an adjustable lock box assembly to accommodate varying widths for the door or window, said adjustable lock box assembly having a lock drive, said adjustable lock assembly configured for removably positioning in the front channel for locking the adjustable backset adapter in the door position via the lock drive engaging the first lock drive connector or in the window position via the lock drive engaging the second lock drive connector; and at least two roller carriages positioned within the track, each of the at least two roller carriages having a plurality of wheels for moving the door or window to an open and a closed position.

2. The gear lock mechanism according to claim 1, further comprising a first pair of vertically spaced holes and a second pair of vertically spaced holes.

3. The gear lock mechanism according to claim 2, wherein the adjustable backset adapter has a corresponding first pair of vertically spaced holes and a corresponding second pair of vertically spaced holes.

4. The gear lock mechanism according to claim 3, wherein the adjustable backset adapter has a first portion and a second portion.

5. The gear lock mechanism according to claim 4, wherein the first portion of the adjustable backset adapter is configured to fit within the front channel of the gear lock mechanism such that the first pair and corresponding first pair of vertically spaced holes align and the second pair and corresponding second pair of vertically spaced holes align.

6. The gear lock mechanism according to claim 5, wherein the second portion of the adjustable backset adapter is substantially flush to the front channel of the gear lock mechanism when the first pair and corresponding first pair of vertically spaced holes and the second pair and corresponding second pair of vertically spaced holes are aligned.

7. The gear lock mechanism according to claim 1, wherein the lock box assembly is removably attachable to the adjustable backset adapter in one of two backset positions.

8. The gear lock mechanism according to claim 1, wherein the lock box assembly is removably attachable to the front channel of the gear lock mechanism.

9. A variable gear lock mechanism for use with a door or window, the door or window adapted to lift and slide, the variable gear lock mechanism comprising:

a vertically oriented front channel having a first connector located in a door position and a second connector located in a window position;

an adjustable backset adapter configured for removably connecting to the front channel, wherein the adjustable backset adapter has a first row of two horizontally spaced holes at a top end and a second row of two horizontally spaced holes at a bottom end to accommodate varying widths for the door or window;

an adjustable lock box configured for removably connecting to the adjustable backset adapter to lock the adjustable backset adapter within the front channel in the door position or in the window position, wherein the adjustable lock box has a corresponding first hole at a top end for aligning with one of the two horizontally spaced holes of the adjustable backset adapter at the top end and a corresponding second hole at a bottom end for aligning with one of the two horizontally spaced holes of the adjustable backset adapter at the bottom end;

a first roller carriage having four wheels; and a second roller carriage having four wheels connected to the first roller carriage, whereby the first and second roller carriages are configured for moving the door or window to an open and closed position.

10. The gear lock mechanism according to claim 9, further comprising a connector for connecting the first and second roller carriages.

11. The gear lock mechanism according to claim 9, further comprising an intermediate roller carriage positioned between the first and second roller carriages.

12. The gear lock mechanism according to claim 11, wherein the intermediate roller carriage has four wheels.

13. The gear lock mechanism according to claim 9, wherein the adjustable backset adapter is configurable to modify the gear lock mechanism for use in a door position or a window position.

* * * * *